United States Patent [19]

Kobayashi et al.

[11] Patent Number: 4,897,637

[45] Date of Patent: Jan. 30, 1990

[54] DISPLAY CONTROLLER

[75] Inventors: Hiroshi Kobayashi; Takeshi Shibasaki; Shinji Suda, all of Itami, Japan

[73] Assignee: Mitsubishi Denki Kabushiki Kaisha, Tokyo, Japan

[21] Appl. No.: 33,466

[22] Filed: Apr. 2, 1987

[30] Foreign Application Priority Data

Apr. 11, 1986 [JP] Japan ..... 61-84721

[51] Int. Cl.[4] ..... G09G 1/14

[52] U.S. Cl. ..... 340/734; 340/750; 340/799

[58] Field of Search ..... 340/734, 790, 745, 798, 340/712, 799, 735, 721, 750

[56] References Cited

U.S. PATENT DOCUMENTS

| | | | |
|---|---|---|---|
| 3,566,361 | 7/1968 | Lavertn et al. | 340/750 |
| 3,967,268 | 6/1976 | Roberts | 340/799 |
| 4,107,741 | 8/1978 | Lemelson | 340/721 |
| 4,213,124 | 7/1980 | Barda et al. | 340/721 |
| 4,314,357 | 2/1982 | Kimura et al. | 340/734 |
| 4,598,284 | 7/1986 | Ikegami et al. | 340/750 |
| 4,625,203 | 11/1986 | DiNitto et al. | 340/750 |
| 4,679,027 | 7/1987 | Higuchi | 340/735 |

FOREIGN PATENT DOCUMENTS 61-272784 12/1986 Japan .

*Primary Examiner*—Alvin Oberley
*Attorney, Agent, or Firm*—Saidman, Sterne, Kessler & Goldstein

[57] ABSTRACT

A display controller including a first ROM, a second ROM, a RAM, and an output circuit. The first ROM stores fixed data to be displayed on a fixed data area of a display screen. The RAM stores variable data to be displayed on a variable data area of the display screen and receives controlling addresses from the first ROM. The second ROM, under control of data from a preselected one of the first ROM or the RAM, outputs the display pattern data to be displayed on the display device. The output circuit latches the display pattern data and sends it to the display device at a predetermined timing.

13 Claims, 4 Drawing Sheets

DISPLAY CONTROLLER

BACKGROUND OF THE INVENTION

This invention relates to a display controller that controls the display of characters or other patterns on a screen of a display device.

A prior art display controller is shown in block diagram form in FIG. 2. As illustrated in FIG. 2, an oscillator circuit 1 provides a clock signal from which a timing generator 2 generates the necessary timing signals, synchronized to the timing of the TV or other display device. In synchronization with these timing signals, a display memory 9 outputs the data of the characters displayed at the corresponding positions on the screen. These data are used as addresses to transfer the desired character patterns from a character ROM 6 to an output circuit 7. In synchronization with the display timing, the output circuit 7 outputs the display patterns, causing characters or patterns to be displayed on the screen. The function of an input control circuit 8 is to write data received from a microcomputer or other external controller into the display memory 9.

When a display controller of the prior art shown in FIG. 2 is used to display, for example, information like the video tape recorder program reservation in FIG. 3 (where the symbol " –" represents a blank space, which must be treated as a type of character) on a TV screen, each screen requires the display of 240 characters (10 lines of 24 characters each). If there are 128 ($=2^7$) characters, and if characters are turned on and off individually, eight bits of data are required. The display memory therefore requires 1920 bits ($=240\times 8$) of rewritable memory (RAM), necessitating a large chip size and attendant cost penalty if the display controller is implemented on a single chip.

Another problem arises when the microcomputer or other controller attempts to control the contents of the display. The need to write 1920 bits of data per screen into the display memory puts excessive load on the controller.

In addition, transfer of the data requires time, resulting in image quality problems.

SUMMARY OF THE INVENTION

An object of the present invention is to provide a display controller that can be implemented on a small LSI chip and can be easily controlled by a microcomputer or other controller.

According to this invention, there is provided a display controller for controlling display on a screen of a display device in respect of each of unit regions forming part of the screen, the area on the screen comprising a fixed data area in which the data to be displayed are fixed and a variable data area in which the data to be displayed can be varied, A first ROM for providing, in relation to each of the unit regions, an area flag signal indicative of whether the unit region is in the fixed data area or in the variable data area, the first ROM further providing fixed data representing the data to be displayed when the unit region is in the fixed data area, and the first ROM further providing address data when the unit region is in the variable data area, a RAM receiving the address data from the first ROM and producing variable data to be displayed in the variable data area, a second ROM receiving the fixed data from the first ROM or the variable data from the RAM, depending on the contents of the area flag signal from the first ROM, and providing a display pattern data to be displayed on said display device, and an output circuit that latches the display pattern data from said second ROM, and feeding the display pattern data to the display device at a predetermined timing.

DETAILED DESCRIPTION OF THE PREFERRED EMBODIMENTS

Figure 1:
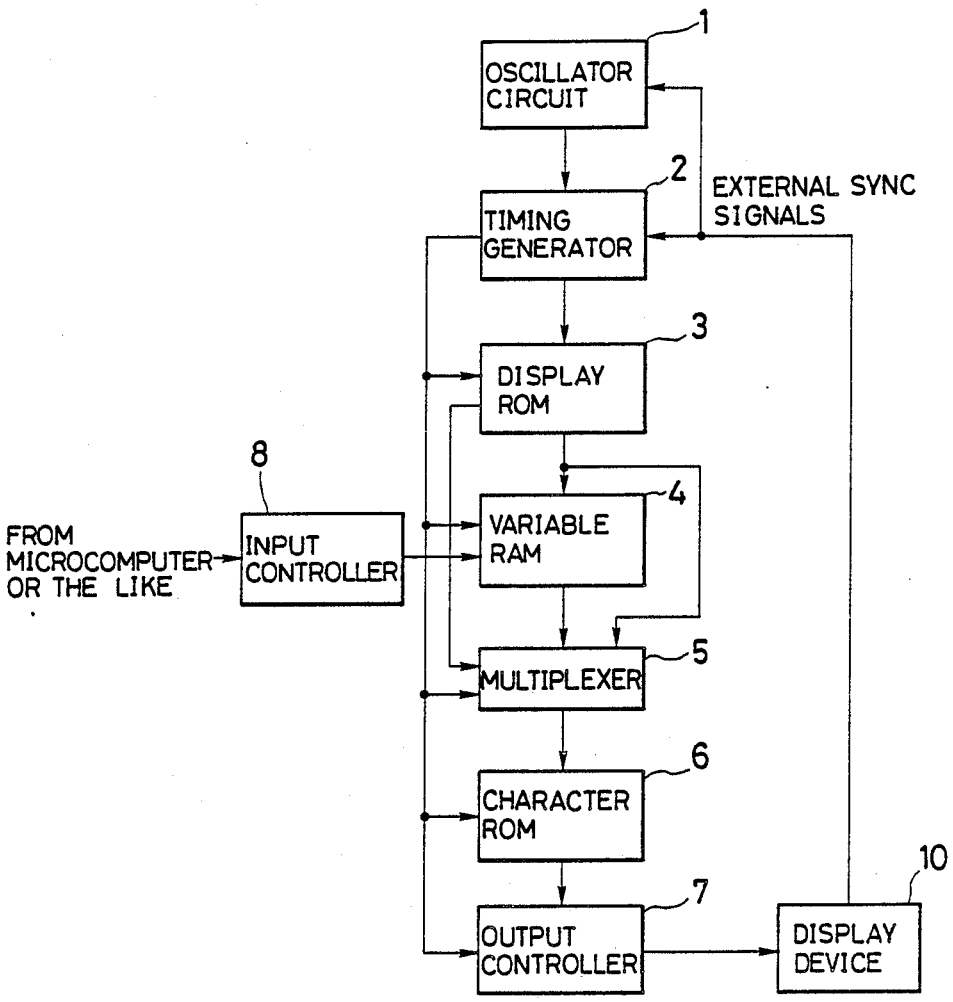
FIG. 1 is a block diagram showing a display controller of an embodiment of the invention.
Figure 2:
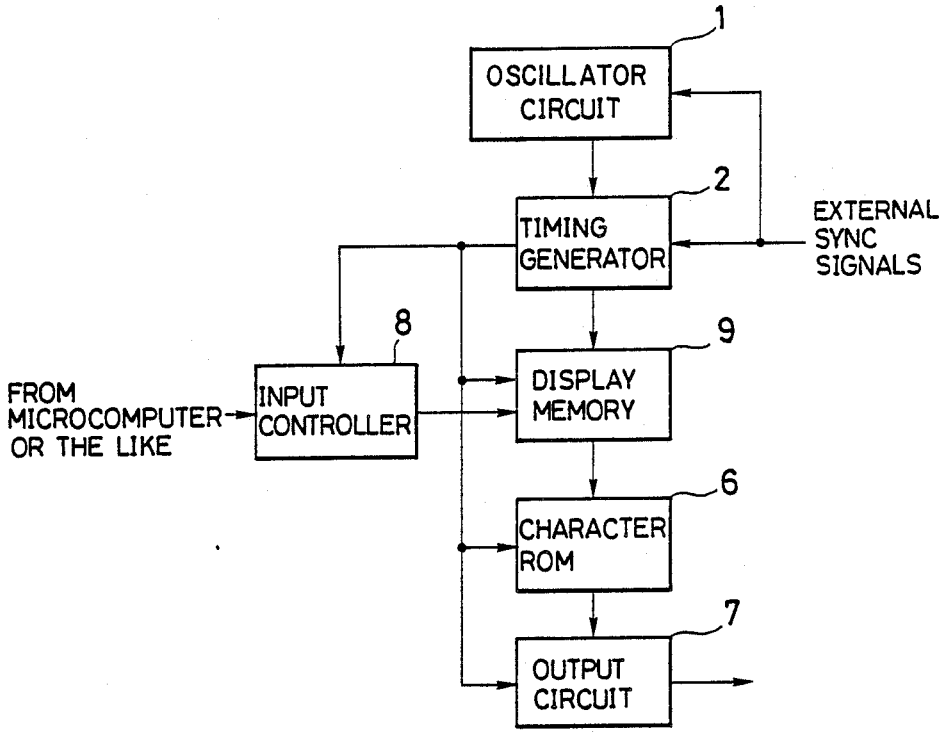
FIG. 2 PRIOR ART
FIG. 2 is a block diagram showing an example of a prior art display controller.

Concepts of the invention will first be described with reference to FIGS. 1, 3 and 4. According to a feature of the invention, the display on a screen of a display device 10 is divided, in data processing, into display in a fixed data area FA (hatched in FIG. 4) in which data to be displayed are fixed and a variable data area or areas VA (unhatched in FIG. 4) in which the data to be displayed are varied. For example, characters which can be varied are circled in FIG. 3. Codes specifying the characters in the fixed data area FA are stored in a display ROM 3, while codes specifying the characters in the variable data area VA are stored in a RAM 4 which can be rewritten.

As is customary with character display, data are processed or controlled in respect of each of unit regions R forming part of the screen. The data for the respective unit regions are processed successively. An area flag signal F distinguishes whether the data being processed is for a unit region R in a fixed data area FA, or for a unit region R in a variable data area VA, this area flag signal F is stored in and produced from the display ROM 3. Depending on the state of this area flag signal F, either the output from the display ROM 3 or the output from the RAM 4 is input to a character ROM 6.

The components and their functions of the display controller of an embodiment of the invention will now be described in turn.

An oscillator circuit 1 provides a clock signal. A timing generator 2 receives the clock signal from the oscillator 1, and creates necessary timing signals synchronized to the display timing of the TV or other display device 10. Input from the display device 10 are the horizontal and vertical sync signals of the video signal, with which synchronization is made. The timing signals are delivered to various circuits so that they operate in synchronism with each other and with the display device 10.

The display ROM 3 may be in the form of the mask ROM. The display ROM 3 stores the contents of a display pattern to be displayed on the display device 10, while the variable RAM 4 stores the variable part of the display pattern. The display ROM 3 produces output data controlling addresses in the RAM 4.

The character ROM 6 contains display pattern data and, under control of either output data from the display ROM 3 or the output data from the RAM 4, outputs the display pattern data to be displayed on the display device 10.

An output circuit 7 latches the output data of the character ROM 6 and sends it to the display device 10 at a predetermined timing, to cause display patterns to be displayed on the display device 10.

Figure 4:
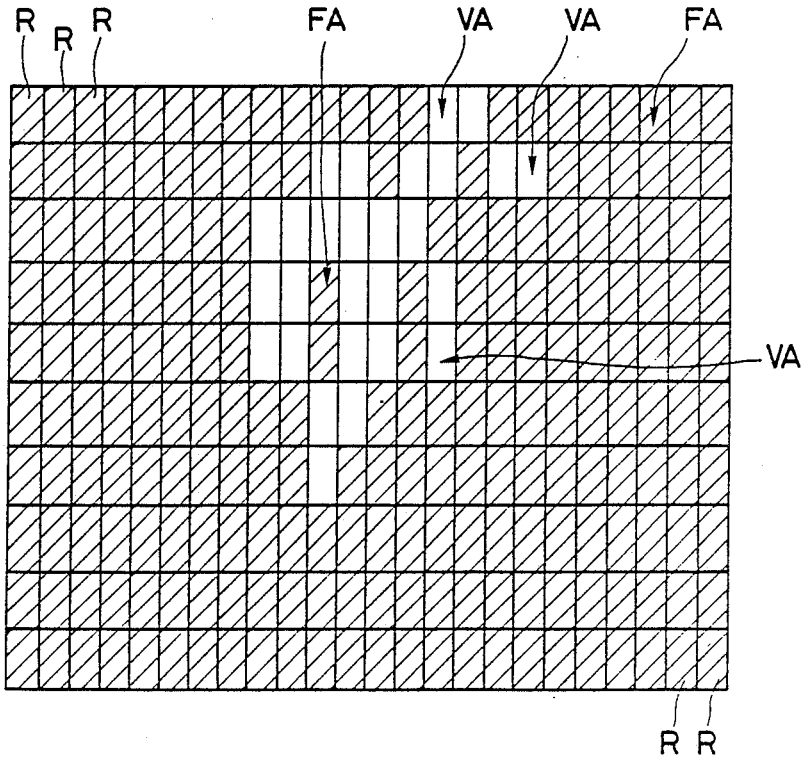
FIG. 4 is a diagram showing a fixed data area FA and variable data areas VA formed of unit regions R.

To give more specific description, the display controller is for controlling display on a screen of the display device in respect of each of unit regions R forming part of the screen, as shown in FIG. 4. The area on the screen comprises a fixed data area FA in which the data to be displayed are fixed and a variable data area VA in which the data to be displayed can be varied.

The display ROM 3 stores, at each of addresses (memory locations) corresponding to respective unit regions R, an area flag signal F indicative of whether the particular unit region R is in the fixed data area FA or in the variable data area VA. The display ROM 3 further stores at each address either fixed character or display pattern data (a code for specifying a character or display pattern) if the corresponding unit region R is in the fixed data area FA, or address data for the RAM 6 if the corresponding unit region R is in the variable data area VA.

The timing generator 2 provides, in sequence, address data of the display ROM 3, which upon receipt of each address data, produces the area flag signal F and the fixed data or the address for the RAM 4.

The RAM 4 stores at each address corresponding to unit regions R in the variable data area, character or display pattern data (a code for specifiying a character or display pattern) to be displayed in the corresponding unit region. When it receives an address data specifying one of such addresses it produces the display pattern data (variable data) in the specified address.

The variable display pattern data in the RAM 4 can be changed or rewritten. This can be done by use of an input control circuit 8 connected to a microcomputer or other external controller, not shown.

The character ROM 6 receives the fixed data from the display ROM 3 or the variable data from the RAM 4, depending on the state or contents of the area flag signal F from the display ROM 3, and provides a display pattern data to be displayed on the display device 10.

The output circuit 7 latches the display pattern data from the display ROM 3 and feeds the display pattern data to the display device 10 at a predetermined, correct timing.

A multiplexer 5 receives the fixed data from the display ROM 3 and the variable data from the RAM 4. Multiplexer 5 outputs the fixed data when the area flag signal F indicates that the unit region R is in the fixed data area FA and outputs the variable data from the RAM 4 when the area flag signal F indicates that the unit region R is in the variable data area VA. The character ROM 6 is connected to receive the output of the multiplexer 5.

The area flag signal F may be in the form of a specific bit not used to specify the addresses in the display ROM 3. For instance, it may be the MSB (most significant bit) of the output of the display ROM 3. For instance, it may be so arranged that when the MSB of the output from the display ROM 3 is at "0" the data from the display ROM 3 specify an address in the character ROM 6 directly, while when the MSB is at "1" the data specify an address in the variable RAM 4. Specifically, this means that on the basis of the MSB from the display ROM 3, the multiplexer 5 selects whether to use the data from the display ROM 3 or the data from the variable RAM 4 as the address data of the character ROM 6.

The output from the character ROM 6 is transferred to the output circuit 7 which may comprise a shift register, and is output in synchronization with the display timing to display a character or pattern on the display screen.

Control of or processing for display for the respective lines takes place successively. For instance the first line (the uppermost line) is processed first, and then the second line, the third line, and so on, During processing of each line, the respective unit regions R are processed or controlled successively, for instance from the left to the right.

Figure 3:
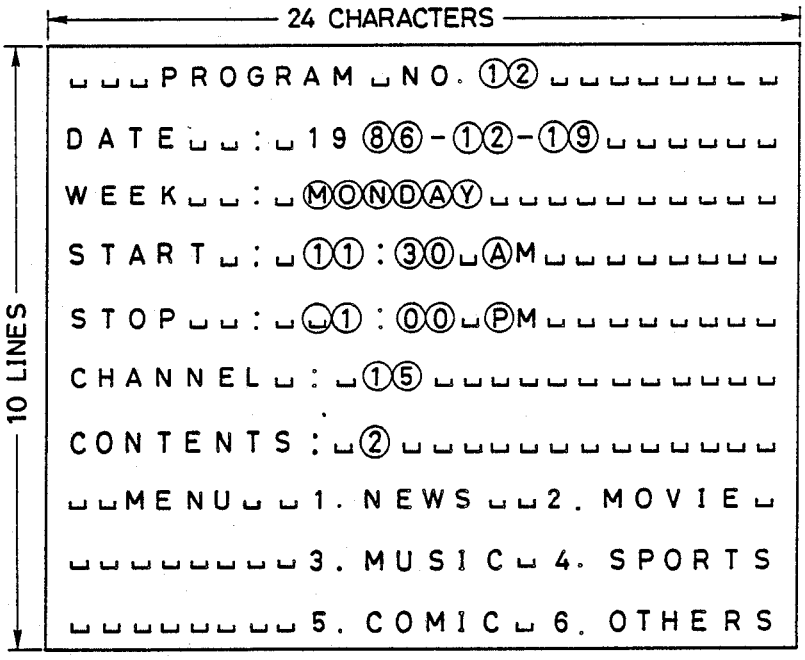
FIG. 3 is a diagram showing an example of display which can be produced by either the display controller of FIG. 1 or the display controller of FIG. 2.

Consider for example the first line of the sample display in FIG. 3. In this line, the circled characters "12" are variable. In other words, the two unit regions for "12" are in the variable data area VA.

While the addresses in the ROM 3 corresponding to 14 unit regions for "␣␣PROGRAM␣ NO." are specified by the timing generator 2 in turn, the ROM 3 itself produces fixed data (codes) respectively specifying "␣␣PROGRAM ␣ NO.", in turn. These fixed data are given to the character ROM 6 through the multiplexer 5, since the ROM 3 is also producing the area flag signal F indicating the fixed data area FA.

When these fixed data are supplied as addresses to the character ROM 6, the character ROM 6 produces display pattern data (character pattern data) for displaying the characters "␣␣PROGRAM␣NO.12".

When the addresses in the ROM 3 corresponding to the unit regions for "12" are specified by the timing generater 2 in turn, the ROM 3 produces address data for the RAM 4, which stores, at the addresses (memory locations) corresponding to the given address data, the variable data (codes) specifying "1" and "2" respectively. These variable data are given to the character ROM 6 and through the multiplexer 5 since the ROM 3 is also producing the area flag signal F indicating the variable data area VA.

These addresses are supplied to the character ROM 6, and the character ROM 6 produces a display pattern data (character pattern data) for displaying the characters "12".

When the addresses in the ROM 3 corresponding to the unit regions for "␣␣␣␣" in the rest of the first line are accessed, the ROM 3 itself produces fixed data for these patterns in turn. Similar operations are performed on other lines.

If the variable data in the RAM is changed, this will be reflected when the address corresponding to the variable data is accessed next. For instance, the data in the RAM 4 for "12" in the first line may be changed to "01". When the addresses for such data are specified by the ROM 3, which in turn is addressed by the timing generator 2, the new data for "01" are produced and supplied to the character ROM 6.

If the full character set consists of 128 characters, 7 bits are required for each character. Where the display ROM 3 is required to specify any of the 128 characters, its output includes these 7 bits plus another bit, e.g., MSB for the area flag signal F. Where it is necessary that any of the 128 characters can be displayed in the variable data area VA, the output of the RAM 6 should also include 7 bits. But where not more than 32 characters are required to be displayed on the variable data area VA, the output of the RAM 4 need only have 5 bits.

Because a ROM can be used for the display memory in this embodiment, the circuit can be much smaller than in the prior art, in which RAM must be used. For a CMOS (complementary metal oxide semiconductor) device, ROM size is in general only 1/6 of RAM size, resulting in a major cost saving in one-chip LSI implementations. Another advantage is that external control can be simple and fast, because the external controller only has to write data to the variable RAM. In addition, the entirety of the display controller can be formed on a single LSI chip.

Although a shift register is used as the output circuit in FIG. 1, any circuit that can be synchronized with the display timing may be used.

The invention is applicable to data processing for display in which data are processed in respect of each of unit regions forming part of the screen. The data pattern may therefore include an element of a line or lines for tables, graphs and the like, and the term "character" or "character display" should be construed to cover such elements or display of such elements.

As described above, according to a display controller of this invention, chip size can be greatly reduced and control by an external controller is simplified, as compared with a conventional display controller in which all the display pattern data are stored in a RAM.

What is claimed is:

1. A display controller comprising a first ROM for storing fixed data to be displayed on a fixed data area of a display device, a RAM, for storing variable data to be displayed on a variable data area of said display device, said first ROM producing an output data for providing controlling addresses to said RAM, a second ROM that, under control of data from a preselected one of said first ROM and said RAM, outputs display pattern data to be displayed on said display device, and an output circuit that latches the display pattern data of said second ROM and sends it to the display device at a predetermined timing.

2. A display controller according to claim 1 characterized in that the entirety of display controller is formed of a single LSI chip.

3. A display controller according to claim 1, wherein the display controller controls a display pattern on a screen of a display device in respect of each of a plurality of unit regions forming part of the screen, said display pattern comprising a variable part and a fixed part, said first ROM provides, in relation to each of the unit regions, an area flag signal indicative of whether the fixed data from said first ROM or variable data from said RAM should be provided as address data to said second ROM, said first ROM further provides the fixed data when the output data from said first ROM should be provided as address data to said second ROM, said first ROM further provides said output data for controlling an address for said RAM when the output data from said RAM should be provided as address data to said second ROM, and said RAM receives the address from said first ROM and produces said variable data to be displayed in the variable data areas, said variable data forming said variable part of said display pattern.

4. A display controller according to claim 3, wherein said second ROM receives the fixed data from the first ROM or the variable data from the RAM, depending on the contents of the area flag signal from the first ROM.

5. A display controller according to claim 3, further comprising a multiplexer receiving the fixed data from said first ROM and the variable data from said RAM and outputting the fixed data when the area flag signal indicates that the unit region is in the fixed data area and outputting the variable data from the RAM when the first data indicates that the unit region is in the variable data area, the second ROM being connected to receive the output of the multiplexer.

6. A display controller according to claim 1, further comprising means for rewriting the variable parts of said display pattern in the RAM.

7. A display controller according to claim 3, further comprising a timing generator providing, in sequence, address data of the first ROM, said first ROM providing upon receipt of each address data from said timing generator, said area flag signal and a predetermined one of said fixed data or said controlling addresses.

8. A display controller for controlling display on a screen of a display device in respect of each of unit regions forming part of the screen, the screen comprising a fixed data area in which the data to be displayed are fixed and a variable data area in which the data to be displayed can be varied, said display controller comprising a first ROM for providing, in relation to each of the unit regions, an area flag signal indicative of whether the unit region is in the fixed data area or in the variable data, the first ROM further providing fixed data codes representing the data to be displayed when the unit region is in the fixed data area, and the first ROM further providing address data when the unit region is in the variable data area, a RAM receiving the address data from the first ROM and producing variable data codes representing the data to be displayed in the variable data area, a second ROM receiving the fixed data codes from the first ROM or the variable data codes from the RAM, depending on the contents of the area flag signal from the first ROM, and providing display pattern data to be displayed on said display device, and an output circuit that latches the display pattern data from said second ROM, and feeding the display pattern data to the display device at a predetermined timing.

9. A display controller according to claim 8, further comprising a multiplexer receiving the fixed data codes from the firm ROM and the variable data codes from the RAM and outputting the fixed data codes when the area flag signal indicates that the unit region is in the fixed data area and outputting the variable data codes from the RAM when the area flag signal indicates that the unit region is in the variable data area, the second ROM being connected to receive the output of the multiplexer.

10. A display controller according to claim 8, further comprising means for rewriting the variable data codes in the RAM.

11. A display controller according to claim 8, further comprising a timing generator providing, in sequence, address data of the first ROM, said first ROM producing upon receipt of said address data from said timing generator, a predetermined one of: (1) said area flag signal and said fixed data codes, or (ii) said address data of the RAM.

12. A display controller according to claim 1, wherein said first and second ROMs and said RAM each comprises a semiconductor device.

13. A display controller according to claim 8, wherein said first and second ROMs and said RAM each comprises a semiconductor device.

* * * * *